United States Patent [19]

Beaucamp

[11] 4,233,581

[45] Nov. 11, 1980

[54] MECHANISM FOR STATIC CONVERGENCE DEVICES FOR COLOR TELEVISION PICTURE TUBES

[75] Inventor: Claude Beaucamp, Montville, France

[73] Assignee: GTE Products Corporation, Stamford, Conn.

[21] Appl. No.: 22,533

[22] Filed: Mar. 21, 1979

[30] Foreign Application Priority Data

Mar. 24, 1978 [FR] France ..... 78 08743

[51] Int. Cl.[3] ..... H01F 7/00

[52] U.S. Cl. ..... 335/212; 335/210

[58] Field of Search ..... 335/210, 212, 213

[56] References Cited

U.S. PATENT DOCUMENTS

| | | | |
|---|---|---|---|
| 2,525,919 | 10/1950 | Loughren | 33 5/212 X |
| 4,065,737 | 12/1977 | Anthony | 335/212 |
| 4,100,518 | 7/1978 | Smith | 335/212 |

*Primary Examiner*—George Harris

*Attorney, Agent, or Firm*—Theodore D. Lindgren

[57] ABSTRACT

An improved color television picture tube static convergence device having a guide-member with bent ledges which slidably mate with circular grooves in sides of non-magnetic rings, the guide-member having a hole for radially positioning a rod with a knob and a pinion which engages mating bevel gears in a conventional magnetic ring pair positioned between the non-magnetic rings.

6 Claims, 12 Drawing Figures

MECHANISM FOR STATIC CONVERGENCE DEVICES FOR COLOR TELEVISION PICTURE TUBES

TECHNICAL FIELD

This invention relates to magnetic devices usually located on the neck of a television color picture tube for initially converging the three electon beams and adjusting the color purity during the color set-up procedure for a particular tube. More particularly the purpose of the invention is to improve the locking mechanism used to maintain the accurate angular adjustments of the magnetic components of a static convergence device.

BACKGROUND ART

As is well-known, such devices are comprised of a plurality of pairs of coaxial rotatable rings made of permanent magnet material and located on a non-magnet mounting sleeve which is designed to be fastened to the neck of a tube. The static magnetic fields generated by permanent magnet poles located in the magnet rings are angularly adjusted such that the outer beams of three in-line electron beams are slightly shifted until they converge with the center beam at a central point behind the screen, the adjustment performed with no dynamic magnetic field generated by the deflection yoke, and thereby causing the beams to strike the correct phosphors on the screen. The magnetic rings are usually provided with ears or other means for the purpose of aiding in the manual angular adjustments. These adjustments comprise two successive operations for each magnet ring pair: first, the optimum angle between the symmetry axes of the rings of a given pair is found, and second the optimum angular location of the given ring pair is determined. The adjusting operations are repeated for each of the plurality of magnetic ring pairs. The complete adjustment operation is time-consuming and is sensitive. Frequencly the adjustment operation must be repeated by the retailer of the television receiver because the rings have been maladjusted during transporation from the factory.

Accordingly, it is desirable to simplify the adjustment operation. Therefore, enhanced mechanisms have been designed to reduce the time spent to obtain the necessary accurate adjustment of magnetic ring pairs to attain static beam convergence.

Prior-art static convergers, including those described in issued French patent applications numbered 2,224,869; 2,244,256; and 2,304,173, disclose improved adjusting assemblies in which the magnetic rings of each pair are concentrically located in the same plane. Such convergers have a toothed wheel located in the space between rings such that the wheel is rotatable around an axis which is fixed with respect to a non-magnetic mounting sleeve. Therefore, when one ring of the pair is rotated in one direction, the other ring of the pair is automatically rotated in the other direction. Using this mechanism, the optimum angle between the symmetry axes of the two rings is easily attained. But such an assembly requires concentric magnet rings of unequal diameter and, therefore, the magnet poles cannot be equidistant to the tube axis. In addition, an intermediate toothed wheel meshing with associated teeth on the rings both increases the production costs and decreases the reliability since a significant friction force must be generated between the magnet rings of each pair to avoid disadjustment during transportation of the television set.

In previously issued French patent application 2,290,029, assigned to the same assignee as the present invention, another type of mechanism for static convergence is disclosed. In accordance with one of the described embodiments, the rings are fabricated using a non-magnet material and magnets are fastened on the ring periphery. A single means is provided on each ring pair for adjusting both operations during the tuning of each ring pair. A member fastened on the periphery of one of the pair of rings houses a rotatable rod which is radially positioned. A knob is attached to the first end of this rod and a pinion is attached to the second end such that the pinion meshes with gears provided in the periphery of the second ring. Therefore, by rotating the knob around its axis, the optimum angle between the rings of one pair may be easily attained, and by angular rotation of the knob around the tube axis both rings are simultaneously rotated without changing the previously obtained angle between the rings.

The described mechanism has been improved in order to ease the tuning adjustments by means disclosed in U.S. Pat. No. 4,050,042 and in German patent application 27 24 061. In such mechanisms, the amplitude of the friction forces is determined by the pressure between adjacent rings after adjusting of all the rings of the complete device. Also, minimum length of the complete device is limited to a relatively large value because each pair of magnetic rings requires two non-magnetic rings.

DISCLOSURE OF THE INVENTION

Accordingly, the described static convergence device is comprised of a mounting sleeve, a pair of rotatable magnet rings mounted on the mounting sleeve, the magnet rings having integral bevel gears facing each other, at least two non-magnetic, non-rotatable rings having grooves located near their periphery, a rotatable rod having a pinion meshing with the bevel gears, and a guide-member which is slidably mounted in the grooves of the non-magnetic ring and which rotatably positions the rod.

The device of this invention provides a new and improved static convergence device having a single adjusting means for each pair of magnetic rings and provides easier and more reliable tuning operations. The design of the device allows construction to be accomplished at decreased cost in comparison to prior-art static convergence devices. In accordance with the present inventon, each magnetic ring pair is located between two non-magnetic rings as in prior-art devices. However, the non-magnetic rings are designed such that only a single non-magnetic ring is required between two adjacent magnetic ring pairs. The non-magnetic rings are non-rotatably mounted on the mounting sleeve which is affixed to the tube neck. Bent ledges are provided on the sides of a guide-member such that the ledges cooperate together with a circular groove provided near the periphery of the non-magnetic rings such that the guide-member can be moved with respect to the rings. One end of a rod radially positioned by the guide-member is attached to a pinion which meshes with bevel gears provided on the peripheries of the magnet rings.

BRIEF DESCRIPTION OF THE DRAWINGS

Features of the present invention are detailed in the following description and the accompanying drawings in which.

PREFERRED MODES OF EMBODIMENT OF THE INVETION

For a better understanding of the present invention, together with other and further objects and advantages thereof, reference is made to the following disclosure and appended claims taken in conjunction with the above described drawings.

Figure 1:
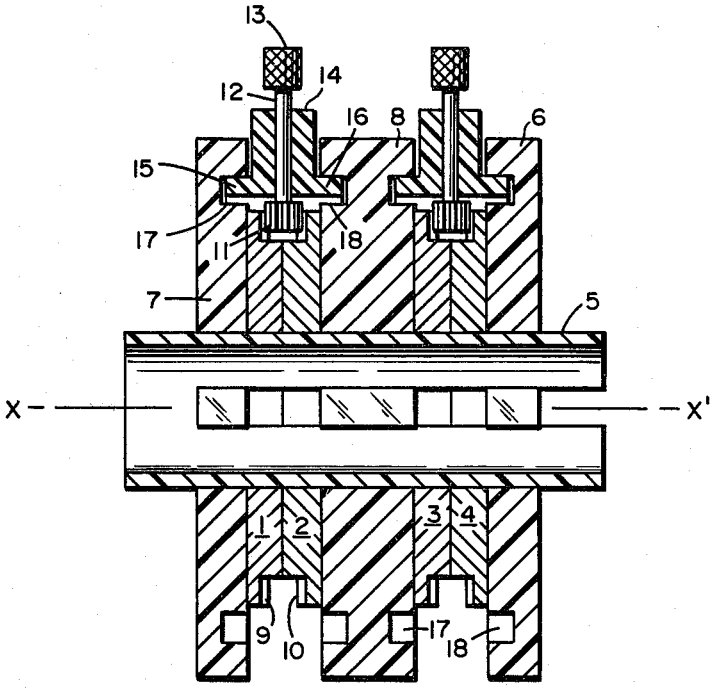
FIG. 1 is an axial sectional view of a static convergence device having two pairs of magnet rings and illustrates the mechanism described and claimed in the present invention.

As indicated, FIG. 1 is a sectional view of the static convergence device illustrating the concepts of this invention. For the purpose of explanation, the device is illustrated using only two pairs of magnet rings. Obviously, a static convergence device may be comprised of more than two pairs of magnet rings and, in fact, usually is comprised of at least three pairs of said rings. Magnetic rings pairs 1 and 2, 3 and 4 are located on a mounting sleeve 5 which is designed to be affixed to the neck of a color cathode ray tube having an axis referenced by a line designated XX'. Non-magnet rings 6 and 7 are non-rotatably positioned at each end of the device and non-magnetic ring 8 is non-rotatably positioned between each adjacent magnet ring pair.

As described in prior art, the magnet rings of each pair have gears 9 and 10 located on their periphery facing each other and operating in conjunction with a pinion 11. Pinion 11 is affixed to one end of rotatable rod 12, the other end of said rod being affixed to a knob 13. Rod 12 has its axis positioned perpendicularly with respect to the tube axis and is radially positioned by a hole through guide-member 14.

Figure 2:
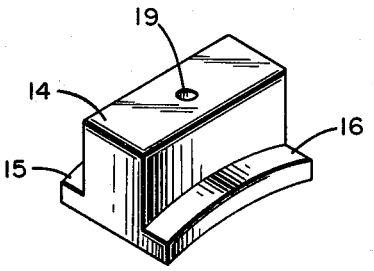
FIG. 2 is an isometric view of the guide-member which is used to position the control rod.

Bent ledges 15 and 16 are provided on the sides of guide-member 14, as shown in FIG. 2. Ledges 15 and 16 are designed for slidable mating with the surfaces of associated circular grooves 17 and 18 provided near the periphery of non-magnet rings 7 and 8 or near the periphery of non-magnetic rings 8 and 6. Therefore, guide-member 14 can be rotated around the tube neck axis and sleeve 5.

Hole 19 is provided in guide-member 14 to rotatably position rod 12.

Figure 3:
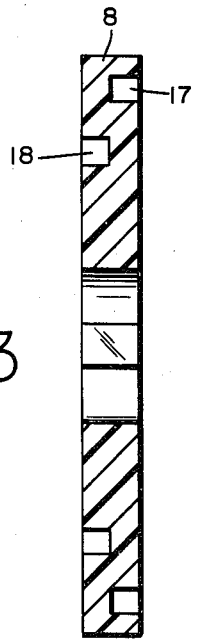
FIG. 3 is an axial sectional view of a non-magnetic ring in which the circular grooves located on either side have different radii.
Figure 4:
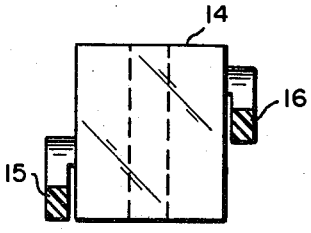
FIG. 4 is a sectional view of a guide-member for use with the non-magnetic rings shown in FIG. 3.

As shown in FIG. 2, ledges 15 and 16 are bent to provide slidable cooperation with the surfaces of circular grooves 17 and 18. In the embodiment represented in FIG. 1, grooves 17 and 18 of non-magnet rings 6, 7 and 8 have the same radius. However, in order to decrease the total length of the complete device, grooves 17 and 18 of internal non-magnetic rings such as ring 8 may have different and non-overlapping radii as shown in FIG. 3. Therefore, the thickness of the internal non-magnet rings may be decreased, consequently requiring less non-magnet material and thereby decreasing production costs. The radii of grooves of end rings 6 and 7 may, of course, be made to correspond to the radii of the nearest groove of an internal ring such as ring 8 or the ledges 15 and 16 may be located at corresponding positions on the guide-member sides as shown in FIG. 4.

When all of the device components are assembled, pinion 11 engages gears 9 and 10 of magnet rings 1 and 2, and the two tuning operations are then performed by handling a single control means for each magnet ring pair. The optimum angle between the symmetry axes of each of the magnet rings of one pair is achieved by rotating the knob 13. Rotation of pinion 11 causes translation of gears 9 and 10 such that the magnetic rings rotate in opposite directions. When the first tuning operation is completed, the second operation begins. Both magnet rings are then angularly rotated in the same direction while conserving the angle of the first operation. By moving the knob 13 around the axis of the tube neck, the guide-member 14 is also moved and through the cooperation of pinion 11 and gears 9 and 10, both magnetic rings are rotated through the same angle in the same direction. The two tuning operations for one ring pair are generally completely independent from each other and are generally independent from the tuning operations of the other ring pairs.

One of the features of the device of this invention is that the two friction-generating forces are perpendicular to each other, one force being parallel to the axis of tube neck (the force generating friction between the magnet rings and the non-magnet rings), the other force being directed radially from the tube axis (the force generating friction between the guide-member ledges and the non-magnet ring grooves). This arrangement presents a fundamental advantage for achieving independence and reliability of tuning while at the same time utilizing non-excessive friction-generating forces which prevent damage to the components. This is an improvement over prior art static convergence devices in which the forces used to generate friction are in a single direction and must be great enough to avoid disadjustment during handling and transport but must be small enough to avoid interaction between the required tuning adjustments and to avoid damage to the components. In general, a good compromise is not realizable for such force components using the design of prior-art static convergence devices.

Figure 5:
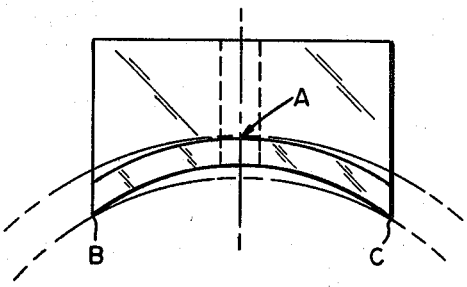
FIGS. 5 and 6 are views of two different embodiments of a guide-member designed to generate an increased frictional force between the grooves of non-magnetic rings and the ledges of said guide-members.

As illustrated in FIG. 5, it is possible to select the friction-generating force between the guide-member ledges 15 and 16 and the non-magnet ring grooves 17 and 18 by limiting the contact surface between those components to three points A, B, and C. This may be accomplished by designing guide-member 14 such that the radius of the bent ledges 15 and 16 is different from the radius of the associated grooves.

Figure 6:
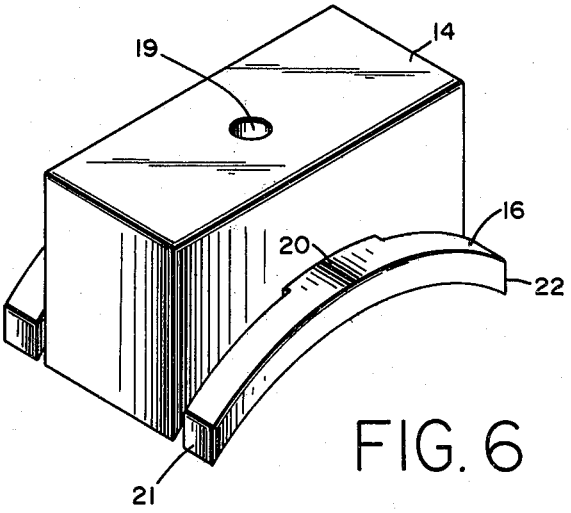

In one embodiment of the invention, bent ledge 16 of FIG. 6, is affixed to guide-member 14 only at its center 20, leaving ends 21 and 22 free to move. The ledge may of course, also be fixed to the side of guide-member 14 at a point other than the center. The ledges may be made from the same non-magnet material as the guide-member, for example from a moldable resinous plastic material or other such elastic material.

Figure 7:
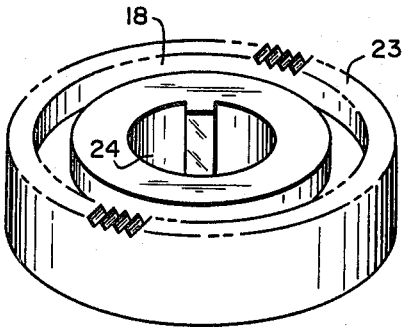
FIGS. 7 and 9, and FIGS. 8 and 10 are respective views of two different embodiments indicating the design of a non-magnet ring and an associated guide-member such that disadjustment of the device is avoided during transport and handling.
Figure 9:
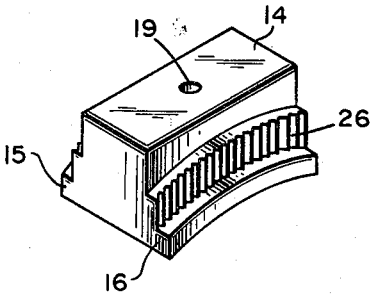
Figure 10:
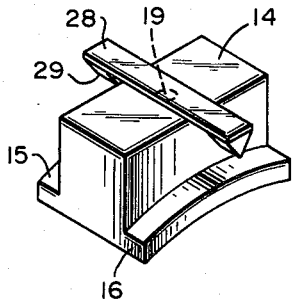

Referring to FIGS. 7 and 9, narrow cogs 23 are provided near groove 18 on each non-magnet ring and the sides of guide-member 14 have complementary cogs such that when the pinion 11 is rotated the cogs slip over each other but such that without rotation of the pinion the cogs fix the respective location of the rings.

Figure 8:
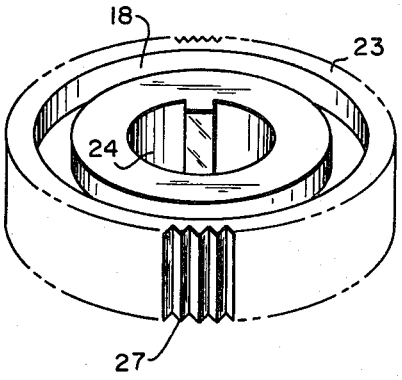

Similar cogs 27 may also be located parallel to the axis of the tube neck as is shown in FIG. 8 on the outer circumference of the non-magnet ring. Using this configuration, a pawl 28 with notch tooth 29 is affixed to guide-member 14 as shown in FIG. 8, the combination comprising a ratchet operating in conjuncion with cogs 27.

Figure 11:
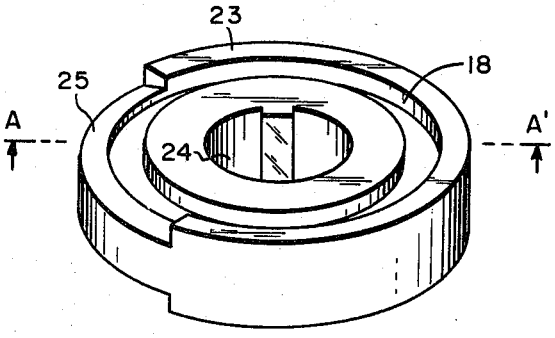
FIG. 11 is an isometric view of a non-magnetic ring in which an angular sector is removed to aid in the assembly operations.
Figure 12:
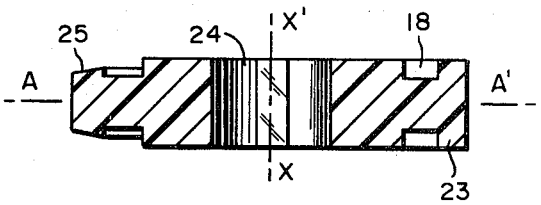
FIG. 12 is a sectional view through the line AA' in FIG. 11.

Referring now to FIG. 11 and 12, the assembling of the components of the static cnvergence device may be made easier by removal of an angular sector 25 from non-magnet ring 18 to allow the ledges of guide-member 14 to be inserted for proper location in the grooves.

It can be seen on the sectional view of FIG. 12 that the proper location of sector 25 allows emplacement of the ledge of guide-member 14 while at the same time preventing undesired disassembly. Using this design production of static convergence devices may be automated, thus decreasing unit costs. In addition, all of the non-magnet rings may be identical whether used between two successive magnet ring pairs or used at an end of the device. Therefore, the cost of plastic molding may also be substantially decreased.

While shown and described are what at present are considered to be the preferred embodiments of the invention, it will be obvious to those skilled in the art that various changes and modifications may be made therein without departing from the scope of the invention as defined by the appended claims.

I claim:

1. An improved color television picture tube static convergence device having a mounting sleeve for attachment to the neck of said tube, having at least one pair of magnetic rings rotatably mounted on said sleeve, each of said magnetic rings constructed and assembled with bevel gears located on their periphery facing each other, and having a rotatable rod radially directed with one end of said rod affixed to a knob and the other end of said rod affixed to a pinion engaged in said bevel gears of said magnetic rings, the improvement comprising non-rotatable non-magnetic rings mounted on said sleeve on either side of said pair of magnetic rings, each of said non-magnetic rings being provided with at least one circular groove located near the periphery of said ring on at least one side of said ring, a guide-member having bent ledges affixed thereto at least one point on each side thereof, said guide-member slidably mating with said grooves, said guide member being provided with a hole rotatably positioning said rod and pinion with respect to said bevel gears.

2. The improved device of claim 1 having at least two pairs of said magnetic rings with said rotatable rods and wherein said circular grooves on said non-magnetic rings have at least two different and non-overlapping radii.

3. The improved device of claim 1 wherein each of said bent ledges has a radius differing from that of said mating groove and wherein each of said bent ledges is comprised of an elastic material shaped to slidably contact the surface of said groove at three or more points.

4. The improved device of claim 1 wherein each of said non-magnetic rings is provided with cogs located near each of said grooves and wherein each side of said guide member is provided with complementary cogs.

5. The improved device of claim 1 wherein each of said non-magnetic rings is provided with cogs located on its outer circumference and wherein said guide member is provided with a pawl and notch tooth to comprise a ratchet to operate in conjunction with said cogs.

6. The improved device of claim 1 wherein each of said non-magnetic rings are provided with a removed angular sector for insertion of said ledges of said guide member.

* * * * *